US009765652B2

(12) United States Patent
Hashimoto et al.

(10) Patent No.: US 9,765,652 B2
(45) Date of Patent: Sep. 19, 2017

(54) ENERGY RECOVERY DEVICE AND COMPRESSION DEVICE, AND ENERGY RECOVERY METHOD

(71) Applicant: Kobe Steel, Ltd., Kobe-shi (JP)

(72) Inventors: Koichiro Hashimoto, Takasago (JP); Haruyuki Matsuda, Kobe (JP); Kazumasa Nishimura, Takasago (JP); Shigeto Adachi, Takasago (JP); Yutaka Narukawa, Takasago (JP); Tetsuya Kakiuchi, Takasago (JP); Kazunori Fukuhara, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 110 days.

(21) Appl. No.: 14/793,876

(22) Filed: Jul. 8, 2015

(65) Prior Publication Data

US 2016/0076405 A1 Mar. 17, 2016

(30) Foreign Application Priority Data

Sep. 17, 2014 (JP) ..... 2014-188719

(51) Int. Cl.
*F01K 25/08* (2006.01)
*F01K 13/02* (2006.01)
*F01K 13/00* (2006.01)

(52) U.S. Cl.
CPC ..... *F01K 25/08* (2013.01); *F01K 13/003* (2013.01); *F01K 13/02* (2013.01)

(58) Field of Classification Search
CPC ..... F01K 25/08; F01K 13/02; F01K 13/003
(Continued)

(56) References Cited

U.S. PATENT DOCUMENTS 6,581,384 B1 * 6/2003 Benson ..... F01K 25/08 60/653
2013/0084164 A1 4/2013 Adachi et al.
(Continued)

FOREIGN PATENT DOCUMENTS

CN 103032101 A 4/2013
CN 103573468 A 2/2014
(Continued)

OTHER PUBLICATIONS

Extended European Search Report issued on Jan. 29, 2016 in European Patent Application No. 15175440.5.

*Primary Examiner* — Hoang Nguyen
(74) *Attorney, Agent, or Firm* — Oblon, McClelland, Maier & Neustadt, L.L.P.

(57) ABSTRACT

An energy recovery device includes a plurality of heat exchangers connected in parallel with each other into which a plurality of heat sources flow, an expander for expanding a working medium, a dynamic power recovery unit, a condenser, a pump for sending the working medium which has flown out from the condenser to the plurality of heat exchangers, and a regulator for regulating inflow rates of the working medium flowing into the plurality of heat exchangers. The regulator regulates the inflow rates of the liquid phase working medium flowing into the plurality of respective heat exchangers such that a difference of temperatures or a difference of degrees of superheat of the gas phase working medium which has flown out from the plurality of respective heat exchangers falls within a certain range. Thereby, heat energy can be efficiently recovered from the plurality of heat sources having temperatures different from each other.

11 Claims, 6 Drawing Sheets

(58) Field of Classification Search
USPC ..... 60/660, 664, 667
See application file for complete search history.

(56) References Cited

U.S. PATENT DOCUMENTS

| | | | | |
|---|---|---|---|---|
| 2014/0223907 | A1* | 8/2014 | Fujioka | F01K 9/003 60/645 |
| 2014/0224469 | A1* | 8/2014 | Mirmobin | F24H 9/2007 165/244 |

FOREIGN PATENT DOCUMENTS

| | | | |
|---|---|---|---|
| EP | 2 578 817 | A2 | 4/2013 |
| EP | 2 693 001 | A1 | 2/2014 |
| JP | 2009-236014 | | 10/2009 |
| JP | 2010-077964 | | 4/2010 |
| JP | 2013-57256 | | 3/2013 |
| JP | 2013-92144 | A | 5/2013 |
| KR | 10-2013-0036162 | A | 4/2013 |
| WO | WO 2009/101977 | | 8/2009 |
| WO | WO 2014/060761 | A2 | 4/2014 |

* cited by examiner

ENERGY RECOVERY DEVICE AND COMPRESSION DEVICE, AND ENERGY RECOVERY METHOD

BACKGROUND OF THE INVENTION

Field of the Invention

The present invention relates to an energy recovery device for recovering heat energy.

Description of the Related Art

Systems for recovering energy contained in compressed gas discharged from a compressor have been recently provided. For example, JP 2013-057256 A discloses an energy recovery system for a compressing device which includes an upstream impeller, a first evaporator for performing a heat exchange between compressed gas discharged from the upstream impeller and a liquid phase working medium, a first cooler for cooling gas which has flown out from the first evaporator, a downstream impeller for compressing gas which has flown out from the first cooler, a second evaporator for performing a heat exchange between compressed gas discharged from the downstream impeller and the liquid phase working medium, a second cooler for cooling gas which has flown out from the second evaporator, a turbine for expanding the gas phase working medium which has flown out from each evaporator, an alternating-current generator connected to the turbine, a condenser for condensing a working medium which has flown out from the turbine, and a circulation pump for sending under pressure the liquid phase working medium which has flown out from the condenser to each evaporator. In this system, the first evaporator and the second evaporator are connected in parallel with each other. Specifically, one portion of the liquid phase working medium discharged from the pump flows into the first evaporator, while the other portion thereof flows into the second evaporator, and these portions of the working medium which have flown out from each evaporator merge with each other upstream of the turbine to flow into the turbine.

Technical Problem

In the system described in JP 2013-057256 A, compression ratios of the respective impellers (respective compressors) which are set differently from each other, for example, may cause compressed gas discharged from the respective compressors to have temperatures different from each other. In this case, in one of the evaporators into which compressed gas having a high temperature flows, a temperature of the gas phase working medium subjected to heat exchange with this compressed gas excessively increases. An increase in the amount of the sensible heat of the gas phase working medium prevents efficient cooling of compressed gas in this evaporator. Moreover, the working medium having a high temperature may damage an instrument provided downstream of this evaporator.

On the other hand, in the other evaporator into which compressed gas having a low temperature flows, an excessively increased flow rate of the working medium flowing into this evaporator causes insufficient evaporation of the working medium. Consequently, sufficiently cooling compressed gas by using the latent heat of the working medium is prevented. Moreover, the two-phase gas-liquid working medium flowing into the turbine may damage the turbine.

The present invention has been made in view of the above problem, and aims to efficiently recover heat energy while recovering heat energy from a plurality of heat sources even when temperatures of the respective heat sources differ from each other.

Solution to Problem

To solve the above problem, the present invention provides an energy recovery device for recovering heat energy from heat sources by using a Rankine cycle of a working medium, the device including: a plurality of heat exchangers connected in parallel with each other in the Rankine cycle, the different heat sources flowing into the respective plurality of heat exchangers; an expander for expanding the working medium which has been subjected to heat exchange with the heat sources in the plurality of respective heat exchangers; a dynamic force recovery unit for recovering dynamic force from the expander; a condenser for condensing the working medium which has flown out from the expander; a pump for sending the working medium which has flown out from the condenser to the plurality of heat exchangers; a plurality of temperature sensors for detecting temperatures of the gas phase working medium which has flown out from the plurality of respective heat exchangers; a plurality of pressure sensors for detecting pressures of the gas phase working medium which has flown out from the plurality of respective heat exchangers; a flow rate regulating valve provided in at least one of a plurality of branch flow passages upstream of the plurality of respective heat exchangers; and a regulator for regulating inflow rates of the liquid phase working medium flowing into the plurality of respective heat exchangers by controlling the flow rate regulating valve, the regulator performing control on the basis of the temperatures detected by the plurality of the respective temperature sensors, or on the basis of respective degrees of superheat calculated on the basis of the temperatures detected by the plurality of the respective temperature sensors and the pressures detected by the plurality of the respective pressure sensors.

In the present invention, the inflow rates of the working medium into the respective heat exchangers are regulated on the basis of the temperatures or the degrees of superheat. Thereby, in one of the heat exchangers, an increase in amount of sensible heat of the gas phase working medium due to an excessive increase in degrees of superheat of the working medium is suppressed, and heat recovery from compressed gas can be efficiently performed. Meanwhile, in the other heat exchangers, the working medium is prevented from flowing out as liquid, the latent heat of the working medium can be effectively used, and heat recovery from compressed gas can be efficiently performed.

Furthermore, a simple configuration in which the opening degree of the flow rate regulating valve is controlled enables regulation of the inflow rates of the working medium into the respective heat exchangers.

Moreover, in the present invention, it is preferable that the energy recovery device further comprises a total flow rate controller for regulating a total flow rate of the liquid phase working medium flowing into the plurality of respective heat exchangers, and the total flow rate controller regulates a flow rate of the liquid phase working medium sent by the pump, on the basis of the temperatures detected by the plurality of the respective temperature sensors, or on the basis of respective degrees of superheat calculated on the basis of the temperatures detected by the plurality of the respective temperature sensors and the pressures detected by the plurality of the respective pressure sensors, such that an average of degrees of superheat or an average of temperatures of the gas phase working medium which has flown out from the plurality of respective heat exchangers falls within a particular range.

Alternatively, in the present invention, it is preferable that the energy recovery device further comprises a total flow rate controller for regulating a flow rate of the liquid phase working medium sent by the pump, and the total flow rate controller regulates the total flow rate of the liquid phase working medium flowing into the plurality of heat exchangers, on the basis of the temperatures detected by the plurality of the respective temperature sensors, or on the basis of respective degrees of superheat calculated on the basis of the temperatures detected by the plurality of the respective temperature sensors and the pressures detected by the plurality of the respective pressure sensors, such that a degree of superheat or a temperature of the gas phase working medium, in which each gas phase working medium which has flown out from the plurality of respective heat exchangers has merged with each other, prior to flowing into the expander falls within a particular range.

With such a configuration, the average degree of superheat can be constantly maintained regardless of change of temperatures of compressed gas, the working medium before flowing into the expander is prevented from being liquid, or vapor having an excessively high temperature. Consequently, the energy recovery device can efficiently recover heat energy in compressed gas.

Moreover, the present invention provides a compression device including: the above energy recovery device; a first compressor for compressing gas; a second compressor for further compressing compressed gas discharged from the first compressor, in which the plurality of heat exchangers of the energy recovery device include a first heat exchanger for recovering heat energy in compressed gas discharged from the first compressor and a second heat exchanger for recovering heat energy in compressed gas discharged from the second compressor.

In the present invention, it is preferable to further include a pressure controller for making a pressure of gas discharged from the first compressor substantially constant and changing a pressure of gas discharged from the second compressor in response to a pressure demanded by a demander, and it is preferable that the regulator further regulates the inflow rates of the liquid phase working medium flowing into the plurality of respective heat exchangers on the basis of a change rate of a pressure or a temperature of gas discharged from the second compressor.

A small time gap from the time when a temperature of compressed gas which is a heat source changes to the time when a temperature of the working medium flowing out from the heat exchangers. In the compression device, a temperature of compressed gas is directly detected, thereby enabling a prompt regulation of the inflow rates of the working medium flowing into the respective heat exchangers in response to a change of temperature of compressed gas. Furthermore, a pressure of compressed gas discharged from the first compressor is made to be substantially constant, thereby enabling regulation of these inflow rates of the working medium to be easily performed.

Moreover, in the present invention, it is preferable that in the case where temperatures of compressed gas discharged from the respective first and second compressors are maintained to be substantially constant, the regulator regulates the inflow rates of the liquid phase working medium flowing into the plurality of respective heat exchangers when regulating an operation of the energy recovery device prior to a supply of compressed gas to a demander.

With such a configuration, regulating the inflow rates of the working medium during supply of compressed gas to a demander is unnecessary.

Moreover, the present invention provides an energy recovery method for recovering heat energy from heat sources by using a Rankine cycle of a working medium, the method including: (a) a step of preparing a plurality of heat exchangers connected in parallel with each other in the Rankine cycle into which the plurality of heat sources flow, and obtaining temperatures or degrees of superheat of the gas phase working medium which have flown out from the plurality of respective heat exchangers; and (b) a step of regulating inflow rates of the liquid phase working medium flowing into the plurality of respective heat exchangers.

In this method, the inflow rates of the working medium into the respective heat exchangers are regulated on the basis of the temperatures or the degrees of superheat. Thereby, in one of the heat exchangers, an increase in amount of sensible heat of the gas phase working medium due to an excessive increase in degrees of superheat of the working medium is suppressed, and heat recovery can be efficiently performed. Meanwhile, in the other heat exchangers, the working medium is prevented from flowing out as liquid, the latent heat of the working medium can be effectively used, and heat recovery can be efficiently performed on the basis of the temperatures or the degrees of superheat.

In this case, it is preferable that the steps (a) and (b) are performed by using an energy recovery device including the plurality of heat exchangers, an expander for expanding the gas phase working medium which has been subjected to heat exchange with the heat sources in the plurality of respective heat exchangers, a dynamic force recovery unit for recovering dynamic force from the expander, a condenser for condensing the liquid phase working medium which has flown out from the expander, a pump for sending the liquid phase working medium which has flown out from the condenser to the plurality of heat exchangers.

Moreover, in the present invention, it is preferable to further include a step of regulating the total flow rate of the liquid phase working medium flowing into the plurality of heat exchangers such that an average of degrees of superheat or an average of temperatures of the gas phase working medium which has flown out from the plurality of respective heat exchangers falls within a particular range, or a degree of superheat or a temperature of the gas phase working medium, in which each gas phase working medium which has flown out from the plurality of respective heat exchangers has merged with each other, prior to flowing into the expander falls within a particular range, while this step is performed before or after the steps (a) and (b), or at the same time with the steps (a) and (b).

With such a configuration, the average degree of superheat can be constantly maintained regardless of change of temperatures of compressed gas, the working medium before flowing into the expander is prevented from being liquid, or vapor having an excessively high temperature. Consequently, the energy recovery device can efficiently recover heat energy in compressed gas.

Effects of the Invention

According to the present invention, as described above, heat energy can be efficiently recovered while recovering heat energy from a plurality of heat sources even when temperatures of the respective heat sources differ from each other.

DESCRIPTION OF THE PREFERRED EMBODIMENTS

Hereinafter, preferred embodiments of the present invention will be described in detail with reference to the accompanying drawings.

First Embodiment

Figure 2:
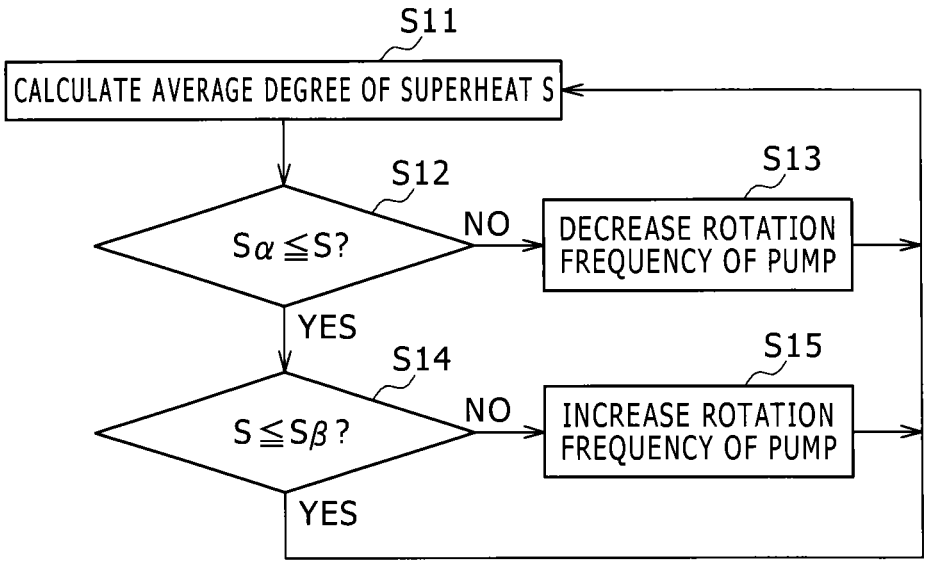
FIG. 2 is a flowchart showing control by a total flow rate controller.
Figure 3:
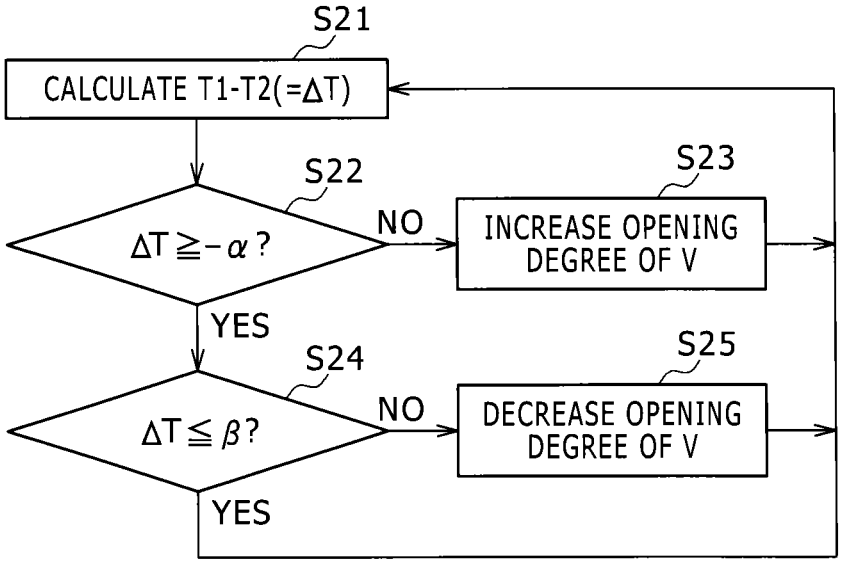
FIG. 3 is a flowchart showing control by a valve controller.

A compression device 1 according to a first embodiment of the present invention will be described in detail with reference to FIGS. 1-3.

Figure 1:
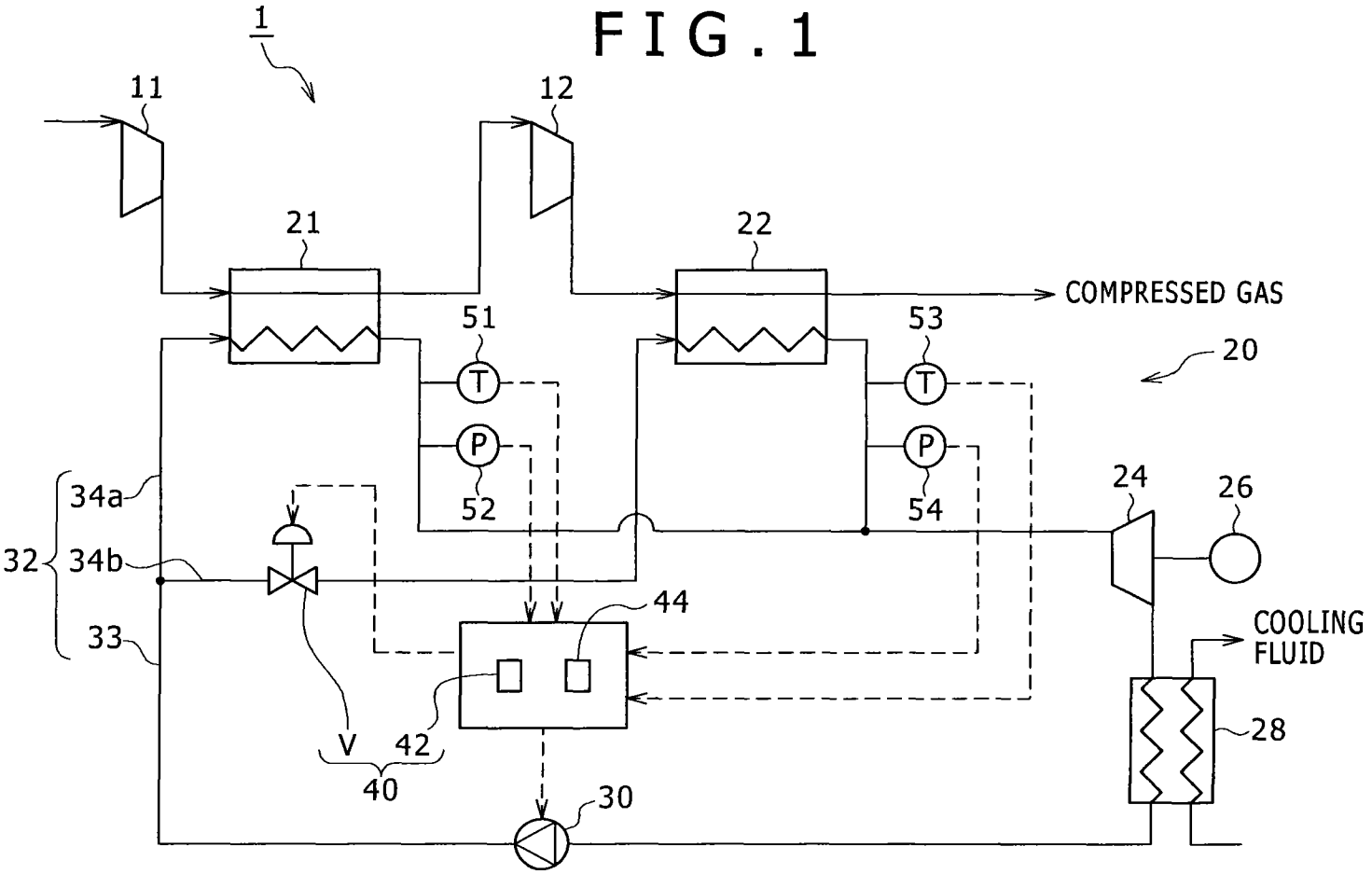
FIG. 1 is a diagram schematically showing a configuration of a compression device according to a first embodiment of the present invention.

As shown in FIG. 1, the compression device 1 includes a first compressor 11 for compressing gas, such as air, a second compressor 12 for further compressing compressed gas discharged from the first compressor 11, and an energy recovery device 20.

The energy recovery device 20 recovers heat energy contained in compressed gas discharged from the first compressor 11 and compressed gas discharged from the second compressor 12 by using a Rankine cycle using a working medium. In this embodiment, as the working medium, organic fluid having a boiling point below that of water, such as R245fa, is used. Specifically, the energy recovery device 20 includes a first heat exchanger 21, a second heat exchanger 22, an expander 24, a generator 26 which is a dynamic force recovery unit, a condenser 28, a pump 30, a circulation flow passage 32, a regulator 40, and a total flow rate controller 44.

The circulation flow passage 32 includes a main flow passage 33 which is a single flow passage, and a first branch flow passage 34*a* and a second branch flow passage 34*b* which bifurcate in parallel with each other from the main passage 33. The working medium circulates in this circulation flow passage 32. In the main flow passage 33, the expander 24, the condenser 28, and the pump 30 are serially connected to one another in this order. The first heat exchanger 21 is connected to the first branch flow passage 34*a*, and the second heat exchanger 22 is connected to the second branch flow passage 34*b*. In other words, the first heat exchanger 21 and the second heat exchanger 22 are connected in parallel in relation to the expander 24, the condenser 28, and the pump 30. In the first branch flow passage 34*a*, a first temperature sensor 51 and a first pressure sensor 52 are provided downstream of the first heat exchanger 21. In the second branch flow passage 34*b*, a second temperature sensor 53 and a second pressure sensor 54 are provided downstream of the second heat exchanger 22.

The first heat exchanger 21 performs heat exchange between compressed gas (heat source) discharged from the first compressor 11 and the liquid phase working medium. Thereby, compressed gas is cooled, and the liquid phase working medium evaporates, which recovers heat energy contained in compressed gas. In other words, the first heat exchanger 21 plays a role as cooler for cooling compressed gas and additionally a role as evaporator for evaporating the liquid phase working medium. The first heat exchanger 21 in this embodiment is of a finned tube type. As the first heat exchanger 21, other heat exchangers, such as that of a plate type, may be used. This also applies to the second heat exchanger 22.

The second compressor 12 is provided downstream of the first heat exchanger 21. A structure of the second compressor 12 is the same as that of the first compressor 11. The second compressor 12 further compresses compressed gas which has been cooled in the first heat exchanger 21.

The second heat exchanger 22 is provided downstream of the second compressor 12. A structure of the second heat exchanger 22 is the same as that of the first heat exchanger 21. The second heat exchanger 22 performs heat exchange between compressed gas (heat source) discharged from the second compressor 12 and the working medium. Note that, in the compression device 1, compressed gas having a high temperature is generated in each of the first compressor 11 and the second compressor 12. Consequently, in the energy recovery device 20, compressed gas flowing into the respective first heat exchanger 21 and second heat exchanger 22 can be regarded as different heat sources.

The expander 24 is provided in the circulation flow passage 32 downstream of the first heat exchanger 21 and the second heat exchanger 22, and further specifically, in the main flow passage 33 downstream of a merging part at which the first branch flow passage 34*a* and the second branch flow passage 34*b* merges with each other, that is, a connection part of downstream end portions of the respective branch flow passages 34*a*, 34*b*. In this embodiment, as the expander 24, a positive displacement screw expander is used. Note that, the expander 24 is not limited to the screw expander, and a centrifugal expander or a scroll expander may be used.

The generator 26 is connected to the expander 24. The generator 26 has a rotary shaft connected to a rotor portion of the expander 24. The generator 26 rotates in accordance with rotation of the rotor portion of the expander 24, thereby generating the electric power.

The condenser 28 is provided in the main flow passage 33 downstream of the expander 24. The condenser 28 cools the gas phase working medium with cooling fluid, such as cooling water, thereby condensing, or liquefying, the same.

The pump 30 is provided in the main flow passage 33 downstream of the condenser and upstream of a branch part from which this main flow passage 33 branches into the first branch flow passage 34*a* and the second branch flow passage 34*b*, that is, a connection part of upstream end portions of the respective branch flow passages 34*a*, 34*b*. The pump 30 pressurizes the liquid phase working medium to a predetermined pressure and sends the same to the first heat exchanger 21 and the second heat exchanger 22. As the pump 30, a centrifugal pump including an impeller as rotor, a gear pump including a rotor having a pair of gears, a screw pump, a trochoid pump, for example, are used.

The regulator 40 regulates inflow rates of the liquid phase working medium into the respective heat exchangers 21, 22. In this embodiment, the regulator 40 includes a flow rate regulating valve V and a valve controller 42 for controlling an opening degree of the flow rate regulating valve V. The flow rate regulating valve V is a valve whose opening degree is regulatable, and is provided in the second branch flow passage 34*b* upstream of the second heat exchanger 22. Regulating the opening degree of the flow rate regulating valve V allows the inflow rates of the liquid phase working medium into the respective first and second heat exchangers 21, 22 to be regulated (these inflow rates are referred to as "distribution rates" hereinafter.).

The total flow rate controller 44 regulates by controlling the rotation frequency of the pump 30 a total flow rate of the liquid phase working medium flowing into the first and second heat exchangers 21, 22, that is, a total flow rate of the liquid phase working medium flowing in the first branch flow passage 34*a* and the second branch flow passage 34*b*. In the compression device 1, the total flow rate controller 44 and the regulator 40 enable the appropriate inflow rates of the liquid phase working medium into the first heat exchanger 21 and the second heat exchanger 22.

When the compression device 1 as described above is driven, compressed gas discharged from the first compressor 11 is cooled in the first heat exchanger 21, further compressed by the second compressor 12, and then cooled in the second heat exchanger 22 to be supplied to a demander. Meanwhile, the working medium evaporated due to recovery of heat energy in compressed gas by the first heat exchanger 21 and the second heat exchanger 22 flows into the expander 24 to expand, thereby driving the expander 24 and the generator 26. The working medium which has flown out from the expander 24 is condensed by the condenser 28. The condensed liquid phase working medium is sent again to the first heat exchanger 21 and the second heat exchanger 22 by the pump 30. Specifically, one portion of the liquid phase working medium discharged from the pump 30 flows through the first branch flow passage 34*a* into the first heat exchanger 21 and the other portion thereof flows through the second branch flow passage 34*b* into the second heat exchanger 22. The working medium circulates in the circulation flow passage 32, as described above, so that the electric power is generated in the generator 26.

Next, an operation for determining the inflow rates of the liquid phase working medium into the respective first heat exchanger 21 and second heat exchanger 22 will be described in detail (this operation is referred to as "flow rate regulation operation" hereinafter.). In the following description, this flow rate regulation operation is performed during supply of compressed gas to a demander by the compression device.

First, the first and second compressors 11, 12 are started so that compressed gas is sent into the first and second heat exchangers 21, 22. Meanwhile, in the energy recovery device 20, the pump 30 is driven, and the working medium is circulated at an initially determined total flow rate. Then, as shown in FIG. 2, the total flow rate controller 44 calculates a degree of superheat of the gas phase working medium which has flown out from the first heat exchanger 21 on the basis of the first temperature sensor 51 and the first pressure sensor 52 (this degree is referred to as "first degree of superheat S1" hereinafter.). Furthermore, the total flow rate controller 44 calculates a degree of superheat of the gas phase working medium which has flown out from the second heat exchanger 22 on the basis of the second temperature sensor 53 and the second pressure sensor 54 (this degree is referred to as "second degree of superheat S2" hereinafter.).

The total flow rate controller 44 calculates an average degree of superheat on the basis of the first degree of superheat S1 and the second degree of superheat S2 (this degree is referred to as "average degree of superheat S" hereinafter.) (step S11).

The total flow rate controller 44 determines whether the average degree of superheat S is greater than or equal to a predetermined lower limit value Sα (step S12). When the average degree of superheat S is less than the lower limit value Sα (NO at the step S12), in other words, when the inflow rates of the liquid phase working medium into the respective heat exchangers 21, 22 are high, the rotation frequency of the pump 30 is decreased by the total flow rate controller 44 by a predetermined ratio (step S13). If the rotation frequency of the pump 30 is decreased, after the elapse of a certain period of time, the average degree of superheat S is measured again and compared with the lower limit value Sα (step S12). When the average degree of superheat S is less than the lower limit value Sα, the rotation frequency of the pump 30 is further decreased (step 13). In this manner, the rotation frequency of the pump 30 is decreased until the average degree of superheat S is greater than or equal to the lower limit value Sα.

If the average degree of superheat S is greater than or equal to the lower limit value Sα (YES at the step S12), the total flow rate controller 44 determines whether the average degree of superheat S is less than or equal to a upper limit value Sβ (step S14). When the average degree of superheat S is less than or equal to the upper limit value Sβ, the average degree of superheat S falls within a desired particular range, that is, within the range from not less than Sα to not more than Sβ.

Then, after the elapse of a certain period of time, the average degree of superheat S is compared again with the lower limit value Sα (step S12). When the average degree of superheat S is less than the lower limit value Sα, the rotation frequency of the pump 30 is decreased until the average degree of superheat S is greater than or equal to the lower limit value Sα. When the average degree of superheat S is greater than or equal to the lower limit value Sα, determination is performed again whether the average degree of superheat S is less than or equal to the upper limit value Sβ (step S14). When the average degree of superheat S is greater than the upper limit value Sβ (NO at the step S14), in other words, when the inflow rates of the liquid phase working medium into the respective heat exchangers 21, 22 are low, the rotation frequency of the pump 30 is increased by the total flow rate controller 44 by a predetermined ratio (step S15). If the rotation frequency of the pump 30 is increased, and after the elapse of a certain period of time, the average degree of superheat S is to be confirmed to be greater than or equal to the lower limit value Sα (step 12), and after the confirmation is made, the average degree of superheat S is compared again with the upper limit value Sβ (step S14). When the average degree of superheat S is greater than the upper limit value Sβ, the rotation frequency of the pump 30 is further increased (step 15). In this manner, the rotation frequency of the pump 30 is increased again and again until the average degree of superheat S is less than or equal to the upper limit value Sβ.

With the procedure described above, in the energy recovery device 20, the total flow rate of the liquid phase working medium is regulated to be appropriate in relation to temperatures of compressed gas, and the average degree of superheat S of the gas phase working medium which has flown out from the first and second heat exchangers 21, 22 is maintained within a particular range, that is, within the range from not less than the lower limit value Sα to not more than the upper limit value Sβ.

Next, in the compression device 1, the rates of distribution to the respective first and second heat exchangers 21, 22 are regulated. First, as shown in FIG. 3, the valve controller 42 obtains a temperature T1 detected by the first temperature sensor 51 and a temperature T2 detected by the second temperature sensor 53 to calculate a temperature difference ΔT which is a difference therebetween (step S21). In this case, ΔT=T1−T2. Hereinafter, the temperature T1 which is a temperature of the gas phase working medium which has flown out from the first heat exchanger 21 is referred to as "first temperature T1." The temperature T2 which is a temperature of the gas phase working medium which has flown out from the second heat exchanger 22 is referred to as "second temperature T2."

Next, the valve controller 42 determines whether the temperature difference ΔT is greater than or equal to a predetermined lower limit value −α in which a is a positive value (step S22). When the temperature difference ΔT is less than the lower limit value −α, in other words, when the second temperature T2 of the working medium which has flown out from the second heat exchanger 22 is excessively higher than the first temperature T1 of the working medium which has flown out from the first heat exchanger 21, the valve controller 42 increases the opening degree of the flow rate regulating valve V by a predetermined opening degree (step S23). Thereby, the distribution rate of the second branch flow passage 34*b* increases while the distribution rate of the first branch flow passage 34*a* decreases. The opening degree of the flow rate regulating valve V is regulated, and after the elapse of a certain period of time, the temperature difference ΔT is compared again with the lower limit value −α (step S22). When the temperature difference ΔT is less than the lower limit value −α, the opening degree of the flow rate regulating valve V is further increased (step 23). In this manner, the opening degree of the flow rate regulating valve V is increased until the temperature difference ΔT is greater than or equal to the lower limit value −α.

If the temperature difference ΔT is greater than or equal to the lower limit value −α, the valve controller 42 determines whether the temperature difference ΔT is less than or equal to a upper limit value β (step S24). When the temperature difference ΔT is less than or equal to the upper limit value β (YES at the step S24), the temperature difference ΔT falls within a desired certain range, that is, within the range from not less than the lower limit value −α to not more than the upper limit value β.

Then, after the elapse of a certain period of time, the temperature difference ΔT is compared again with the lower limit value −α(step S22). When the temperature difference ΔT is less than the lower limit value −α, the opening degree of the flow rate regulating valve V is increased until the opening degree of the flow rate regulating valve V is greater than or equal to the lower limit value −α. When the temperature difference ΔT is greater than or equal to the lower limit value −α, determination is performed whether the temperature difference ΔT is less than or equal to the upper limit value β (step S24). When the temperature difference ΔT is greater than the upper limit value β, in other words, when the first temperature T1 of the working medium which has flown out from the first heat exchanger 21 is excessively higher than the second temperature T2 of the working medium which has flown out from the second heat exchanger 22, the valve controller 42 decreases the opening degree of the flow rate regulating valve V by a predetermined opening degree (step S25). Thereby, the distribution rate of the liquid phase working medium into the first heat exchanger 21 increases while the distribution rate of the liquid phase working medium into the second heat exchanger 22 decreases. Then, after the elapse of a certain period of time, the temperature difference ΔT is to be confirmed to be greater than or equal to the lower limit value −α (step 22), and after the confirmation is made, the temperature difference ΔT is compared with the upper limit value β. When the temperature difference ΔT is greater than the upper limit value β, the opening degree of the flow rate regulating valve V is further increased (step 25). In this manner, the opening degree of the flow rate regulating valve V is increased again and again until the temperature difference ΔT is less than or equal to the upper limit value β.

With the procedure described above, the valve controller 42 regulates the distribution rates again and again, which prevents the rates of distribution to the respective first heat exchanger 21 and second heat exchanger 22 from being uneven. Thereby, the difference of the temperatures of the gas phase working medium which has flown out from the respective first heat exchanger 21 and second heat exchanger 22 falls within a predetermined certain range, that is, within the range from not less than the lower limit value −α to not more than the upper limit value β, and a difference in degrees of superheat of the working medium is prevented from being excessively great. Note that, when, after regulation of the distribution rates, temperatures of compressed gas of the respective first compressor 11 and second compressor 12 largely vary, and the average degree of superheat S falls out of a particular range, that is, within the range from not less than Sα to not more than Sβ, the total flow rate is reregulated such that the average degree of superheat S falls within this range, and the distribution rates are reregulated as well.

The structure of the compression device 1 and the flow rate regulation operation in this embodiment have been described above. Suppose that a difference in degrees of superheat between the first and second heat exchangers 21, 22 is excessively great, in one of the heat exchangers in which the distribution rate is low, the working medium flows out as vapor having an excessively great degree of superheat, and, as the heat absorbed by the working medium, the rate of the sensible heat having heat quantity less than that of the latent heat increases. Meanwhile, in the other heat exchanger in which the distribution rate is high, the working medium flows out as liquid or two-phase gas liquid, and the latent heat cannot be sufficiently used. Consequently, in neither of these exchangers, heat energy can be efficiently recovered, in other words, compressed gas can be sufficiently cooled.

On the contrary, in the compression device 1, the total flow rate controller 44 regulates the total flow rate such that the average degree of superheat S remains within a particular range. Thereby, the average degree of superheat can be constantly maintained regardless of change of temperatures of compressed gas. Consequently, the working medium before flowing into the expander 24, that is, the working medium in a flow passage portion from the merging part of the first branch flow passage 34*a* and the second branch flow passage 34*b* to the expander 24 is prevented from being liquid, or, on the contrary, being vapor having an excessively great degree of superheat. As a result, the energy recovery device 20 can efficiently recover heat energy in compressed gas. Moreover, damage to the expander 24 can be reliably prevented.

Furthermore, in the compression device 1, the distribution rates of the liquid phase working medium flowing into the respective first and second heat exchangers 21, 22 are regulated such that a difference of the temperatures of the gas phase working medium which has flown out from the respective first heat exchanger 21 and second heat exchanger 22 falls within a certain range. Consequently, a difference in degrees of superheat of the working medium between the first and second heat exchangers 21, 22 can be suppressed, heat recovery from compressed gas can be further efficiently performed, and compressed gas can be sufficiently cooled as well. Moreover, damage to the instruments in the first branch flow passage 34*a* due to the working medium flowing out from the first heat exchanger 21 as vapor having a high temperature is prevented. This also applies to the second heat exchanger 22. Furthermore, influence of compressed gas having a high temperature on the second compressor 22 or the facility of a demander is prevented.

In the energy recovery device 20, the opening degree of the flow rate regulating valve V is controlled so that the rates of the working medium distributed to the respective first and second heat exchangers 21, 22 can be easily regulated.

In the first embodiment, when the total flow rate of the working medium is regulated, it is also possible to perform determination is whether the average degree of superheat S is less than or equal to the upper limit value β before performing determination whether the average degree of superheat S is greater than or equal to the lower limit value Sα. Furthermore, the total flow rate controller 44 may regulate the rotation frequency of the pump 30 such that an average of the first temperature T1 and the second temperature T2 falls within a particular range. This also applies in the second embodiment.

When the distribution rates of the working medium is regulated, it is also possible to perform determination is whether the temperature difference ΔT is less than or equal to the upper limit value Sβ before performing determination whether the temperature difference ΔT is greater than or equal to the lower limit value −α. The valve controller 42 may regulate the opening degree of the flow rate regulating valve V such that a difference between the first degree of superheat S1 and the second degree of superheat S2 falls within a certain range. This also applies in the second embodiment.

Modification of the First Embodiment

Figure 4:
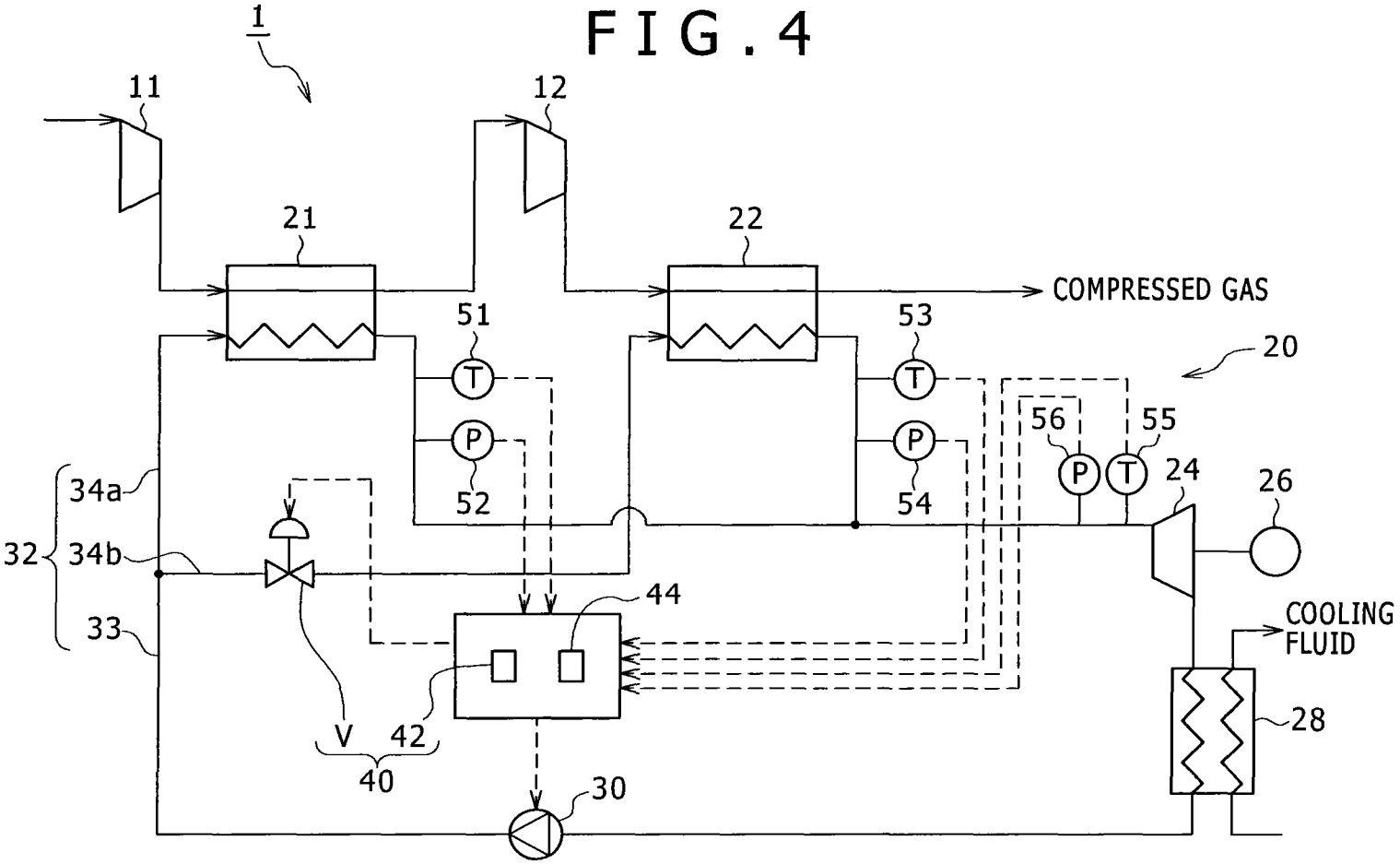
FIG. 4 is a diagram showing a modification of the compression device of FIG. 1.

FIG. 4 is a diagram showing a modification of the first embodiment. As shown in FIG. 4, a temperature sensor 55 and a pressure sensor 56 are provided in a flow passage portion ranging from the merging part of the first branch flow passage 34*a* and the second branch flow passage 34*b* to the expander 24. In the energy recovery device 20, a degree of superheat calculated on the basis of the temperature sensor 55 and the pressure sensor 56, that is, a degree of superheat of the gas phase working medium, in which the gas phase working media which has flown out from the first heat exchanger 21 and the gas phase working medium which has flown out from the second heat exchanger 22 have merged with each other, prior to flowing into the expander 24 is obtained. Moreover, the total flow rate controller 44 regulates the rotation frequency of the pump 30 such that this degree of superheat falls within the above particular range, that is, within the range from not less than the lower limit value Sα to not more than the upper limit value Sβ, thereby regulating the total flow rate of the working medium. Details of an operation for regulating the total flow rate are similar to those as shown in FIG. 2.

Thereby, also with the configuration as shown in FIG. 4, the average degree of superheat can be constantly maintained regardless of change of temperatures of compressed gas, and the energy recovery device 20 can efficiently recover heat energy in compressed gas.

In the energy recovery device 20, the total flow rate controller 44 may regulate the rotation frequency of the pump 30 such that a temperature detected by the temperature sensor 55 and the pressure sensor 56, that is, a temperature of the gas phase working medium, in which the gas phase working medium which has flown out from the first heat exchanger 21 and the gas phase working medium which has flown out from the second heat exchanger 22 have merged with each other, prior to flowing into the expander 24 falls within a particular range.

Another Modification of the First Embodiment

The above flow rate regulation operation is not necessarily required to be performed during supply of compressed gas to a demander, and may be performed before compressed gas is supplied to a demander and during an operation for regulating operations of the respective instruments of the compression device 1 which include the energy recovery device 20 (this operation is referred to as "regulation operation" hereinafter.).

In this case, first, the first and second compressors 11, 12 are started so that compressed gas is sent into the first and second heat exchangers 21, 22. Meanwhile, the working medium is circulated in the energy recovery device 20 by the pump 30. Then, a total flow rate regulation is performed by the total flow rate controller 44.

Figure 5:
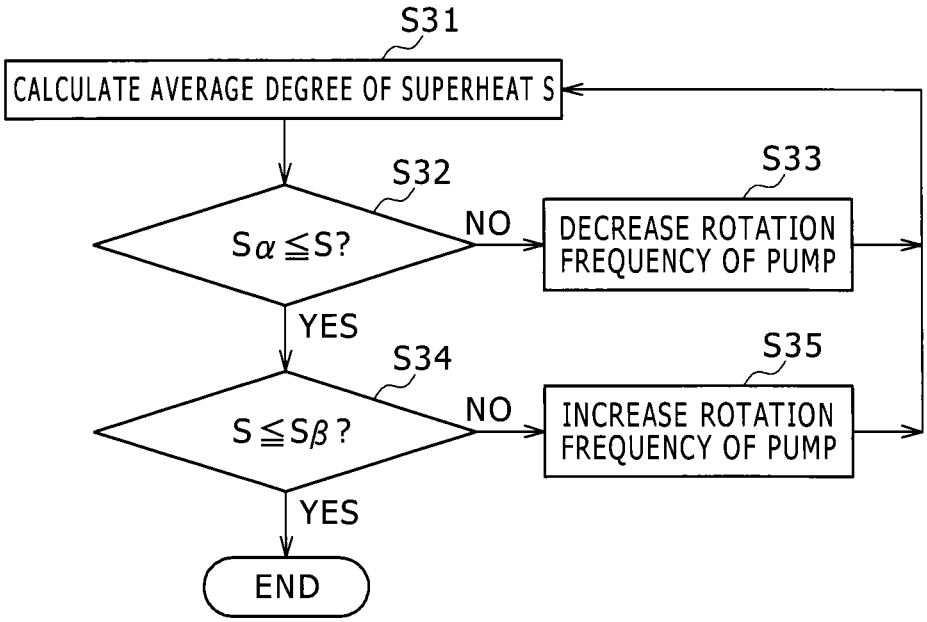
FIG. 5 is a flowchart showing control by a total flow rate controller according to another modification.

FIG. 5 is a flowchart showing procedure of the total flow rate regulation. Except a step S34, FIG. 5 is similar to FIG. 2. First, the total flow rate controller 44 calculates the above average degree of superheat S on the basis of the first degree of superheat S1 and the second degree of superheat S2 (step S31). Then, the rotation frequency of the pump 30 is decreased in a stepwise manner by the total flow rate controller 44 until the average degree of superheat S is greater than or equal to the predetermined lower limit value Sα (steps S32, S33). If the average degree of superheat S is greater than or equal to the lower limit value Sα, the total flow rate controller 44 determines whether the average degree of superheat S is less than or equal to the upper limit value Sβ (step S34), and when the average degree of superheat S is less than or equal to the upper limit value Sβ, the total flow rate regulation is completed.

On the other hand, when the average degree of superheat S is greater than the upper limit value Sβ, the average degree of superheat S is to be confirmed to be greater than or equal to the lower limit value Sα, and after the confirmation is made, the rotation frequency of the pump 30 is increased in a stepwise manner until the average degree of superheat S is less than or equal to the upper limit value Sβ (steps S32, S34, S35). If the average degree of superheat S is confirmed to fall within the range from not less than the lower limit value Sα to not more than the upper limit value Sβ (steps S32, S33), the total flow rate regulation is completed.

Figure 6:
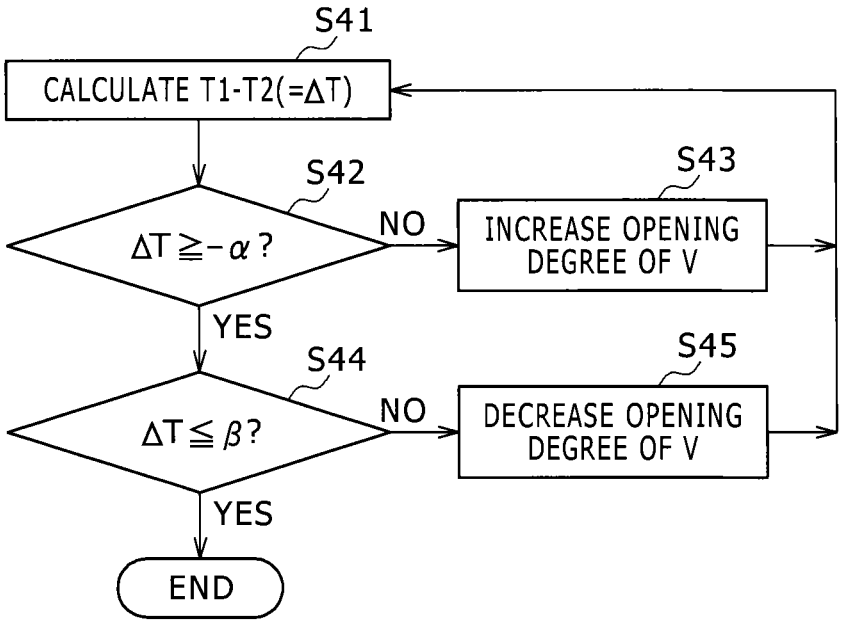
FIG. 6 is a flowchart showing control by a valve controller according to another modification.

Next, a distribution rate regulation is performed by the valve controller 42. FIG. 6 is a flowchart showing procedure of the distribution rate regulation. Except a step S44, FIG. 6 is similar to FIG. 3. First, the valve controller 42 calculates the temperature difference ΔT between the temperature T1 and the temperature T2 (step S41). In this case, ΔT=T1−T2. Then, the degree of opening of the flow rate regulating valve V is increased in a stepwise manner by the valve controller 42 until the temperature difference ΔT is greater than or equal to the predetermined lower limit value −α (steps S42, S43). If the temperature difference ΔT is greater than or equal to the lower limit value −α, the valve controller 42 determines whether the temperature difference ΔT is less than or equal to the upper limit value β (step S44), and when the temperature difference ΔT is less than or equal to the upper limit value β, the distribution rate regulation is completed.

On the other hand, when the temperature difference ΔT is greater than the upper limit value β, the temperature difference ΔT is to be confirmed to be greater than or equal to the lower limit value −α, and after the confirmation is made, the degree of opening of the flow rate regulating valve V is decreased in a stepwise manner until the temperature difference ΔT is less than or equal to the upper limit value β (steps S42, S44, S45). If the temperature difference ΔT is confirmed to fall within the range from not less than the lower limit value −α to not more than the upper limit value β (steps S42, S43), the distribution rate regulation is completed.

In the compression device 1, the flow rate regulation operation is performed during the regulation operation so that, particularly, pressures of the compressed gas discharged from the respective first compressor 11 and second compressor 12 scarcely vary. In other words, when temperatures of compressed gas are substantially constant, the flow rate regulation operation after start of supplying compressed gas to a demander by the compression device 1 is unnecessary.

The flow rate regulation operation during the above regulation operation is not necessarily required to be performed by the total flow rate controller 44 and the valve controller 42, and may be performed by regulating by an operator the rotation frequency of the pump 30 and the opening degree of the flow rate regulating valve V on the basis of the average degree of superheat and the temperature difference of the working medium.

Second Embodiment

Figure 7:
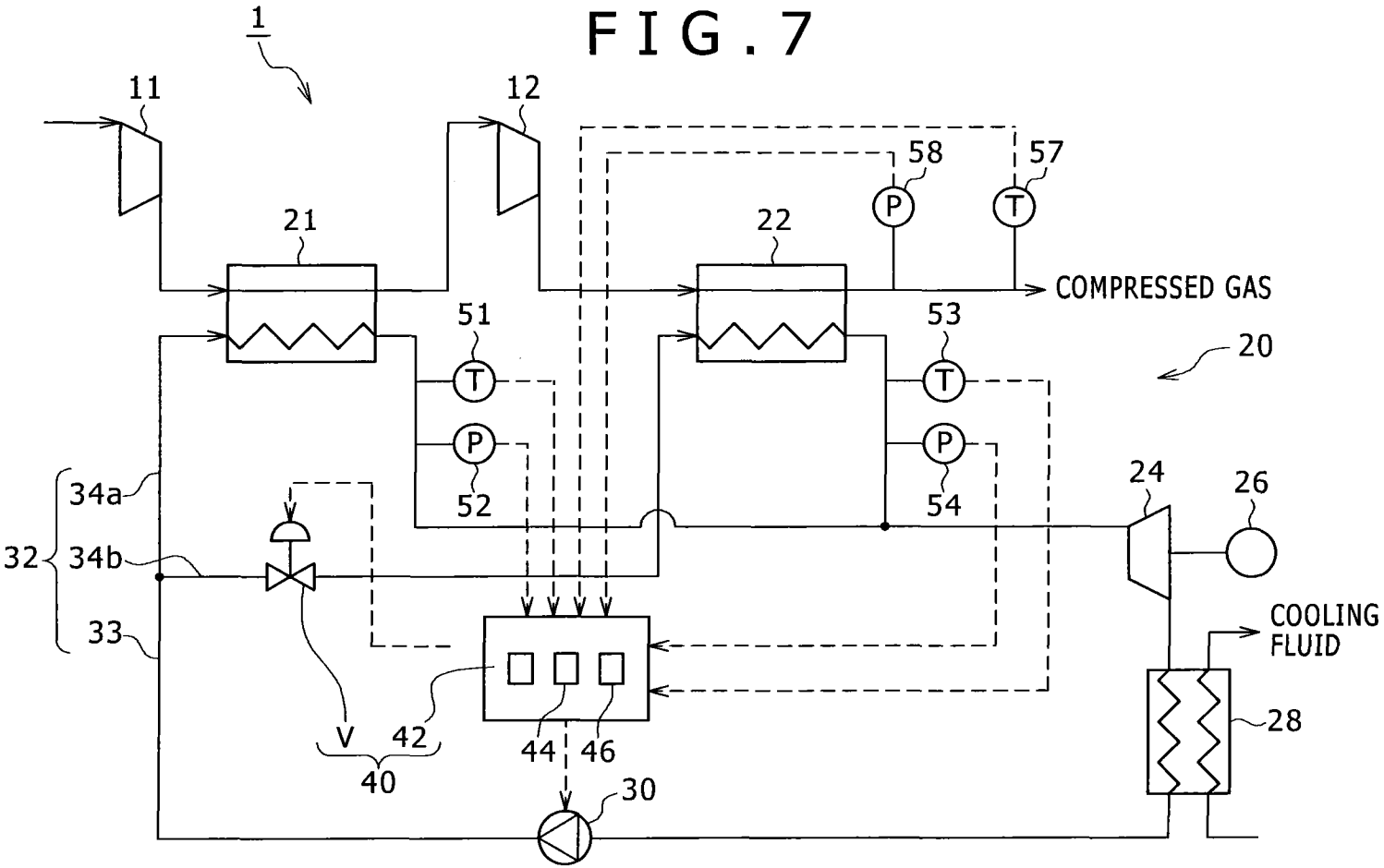
FIG. 7 is a diagram schematically showing a configuration of a compression device according to a second embodiment of the present invention.

FIG. 7 shows the compression device 1 according to a second embodiment. In the compression device 1, a temperature sensor 57 and a pressure sensor 58 are provided in a compression gas flow passage downstream of the second compressor 12. Except these, the configuration is similar to that of the first embodiment, and the similar components will be described with the same reference numerals hereinafter.

In the compression device 1, a pressure of compressed gas discharged from the first compressor 11 is made to be substantially constant and a pressure of compressed gas discharged from the second compressor 12 is changed in response to a pressure demanded by a demander by a compressor controller 46. Except the flow rate regulation operation, the other operations of the compression device 1 are similar to those in the first embodiment.

Next, a procedure of the flow rate regulation operation will be described in detail. When a regulation operation of the compression device 1 is performed, first, the first and second compressors 11, 12 are started so that compressed gas is sent into the first and second heat exchangers 21, 22. Meanwhile, a discharge pressure of compressed gas discharged from the second compressor 12 is a predetermined pressure (hereinafter referred to as "reference pressure"). A temperature of compressed gas relative to the reference pressure (hereinafter referred to as "reference temperature") is detected by the temperature sensor 57. Moreover, as described above, the discharge pressure of compressed gas discharged from the first compressor 11 is substantially constant, and a temperature of compressed gas relative to this discharge pressure is obtained in advance.

In the energy recovery device 20, the pump 30 is driven, and the working medium is circulated at an initially determined total flow rate.

Next, in the same way as in the first embodiment, the total flow rate of the liquid phase working medium in the circulation flow passage 32 is determined by the total flow rate controller 44. Specifically, the average degree of superheat S is calculated from the first and second degrees of superheat S1, S2, and the rotation frequency of the pump 30 is regulated such that the average degree of superheat S falls within the range from not less than the lower limit value Sα to not more than the upper limit value Sβ (FIG. 5: steps S31 to S35).

Then, in the same way as in the first embodiment, the rates of distribution to the respective first and second heat exchangers 21, 22 are regulated. Specifically, the opening degree of the flow rate regulating valve V is regulated by the valve controller 42 such that the temperature difference ΔT between the temperature T1 and the temperature T2 falls within a certain range (FIG. 6: steps S41 to S45).

Figure 8:
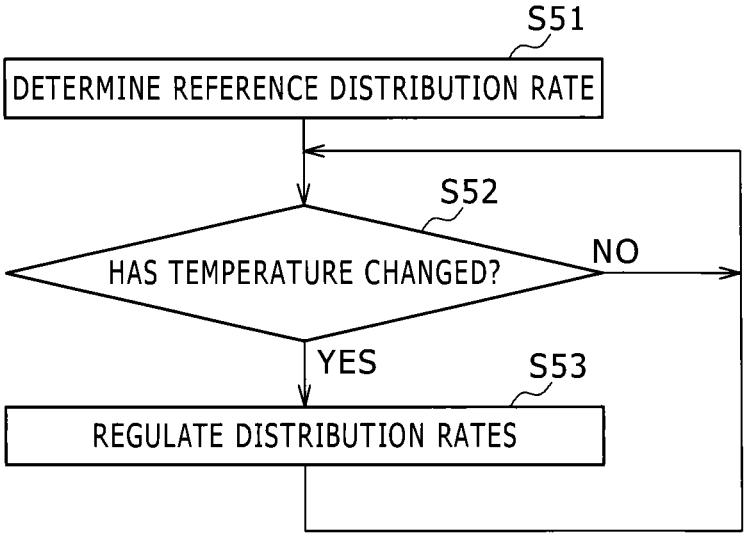
FIG. 8 is a flowchart showing procedure of regulating distribution rates of a working medium according to the second embodiment.

With the above procedure, a distribution rate of the working medium relative to the reference temperature of compressed gas discharged from the second compressor 12 (hereinafter referred to as "reference distribution rate") is determined (FIG. 8: step S51). In this case, if the temperature difference ΔT falls within a certain range, the reference distribution rate is not required to be determined strictly at a single value.

Then, the regulation operation of the compression device 1 is completed, and supply of compressed gas to a demander is started. If a pressure demanded by a demander is changed while the compression device 1 is driven, the discharge pressure of compressed gas discharged from the second compressor 12 is changed by the compressor controller 46, and a temperature of this compressed gas changes from the reference temperature (step S52). In this case, in the energy recovery device 20, a change rate of a temperature of compressed gas relative to the reference temperature is obtained in the valve controller 42, and, on the basis of this change rate, the distribution rate of the working medium flowing into the second heat exchanger 22 is changed from the reference distribution rate (step S53). The distribution rate of the working medium posterior to change may be obtained as a value in which the reference distribution rate is multiplied by the above change rate, and further alternatively as a value in which this value is multiplied, or added and/or subtracted by an adjustment value.

In the energy recovery device 20, a change of a temperature of compressed gas is constantly detected while the compression device 1 is driven. When the temperature changes (step S52), a change rate of the temperature of compressed gas relative to the reference temperature is obtained, as described above, and, on the basis of this change rate, the distribution rate is changed from the reference distribution rate again and again (step S53).

The procedure of the flow rate regulation operation has been described above. In the energy recovery device 20, the distribution rates of the working medium flowing into the respective first and second heat exchangers 21, 22 are regulated before the distribution rates are reregulated on the basis of a change rate of a temperature of compressed gas from the second compressor 12. Consequently, from compressed gas discharged from the first compressor 11 and compressed gas discharged from the second compressor 12, in one heat exchanger into which compressed gas having a high temperature flows, the distribution rate of the working medium is increased, and in the other heat exchanger into which compressed gas having a low temperature flows, the distribution rate of the working medium is decreased. As a result, heat energy in compressed gas can be efficiently recovered.

In the compression device 1, a short time interval is required from the time when a temperature of compressed gas changes to the time when a temperature of the working medium flowing out from the second heat exchanger 22 changes. In the compression device 1, a temperature of compressed gas is directly detected to regulate the distribution rates, thereby enabling a further prompt response to a change of the temperature of compressed gas in comparison with the case where the distribution rates are regulated on the basis of a temperature and a degree of superheat of the working medium. Furthermore, a pressure of compressed gas discharged from the first compressor 11 is made to be constant, thereby enabling the flow rate regulation operation to be easily performed.

In the second embodiment, a change rate of a pressure of compressed gas posterior to change relative to the reference pressure is obtained, and on the basis of this change rate, the distribution rate of the working medium flowing into the heat exchanger 22 may be changed from the reference distribution rate.

In the flow rate regulation operation, an operation for obtaining the reference distribution rate may be performed during supply of compressed gas to a demander. The reference distribution rate may be redetermined in accordance with changes of a temperature of compressed gas.

Note that the embodiments disclosed herein are provided for illustration only and should not be construed as limiting the present invention in any way. The scope of the invention is defined not by the description provided above but by the claims, and is intended to include concepts equivalent to the claims and all modifications within the claims.

For example, in the valve controller 42, the distribution rates of the working medium flowing into the respective first and second heat exchangers 21, 22 may be regulated such that a value in which the first temperature T1 is divided by the second temperature T2 falls within a certain range. Needless to say, the distribution rates may be regulated on the basis of a value in which the second temperature T2 is divided by the first temperature T1. The distribution rates may be regulated on the basis of a ratio of the first temperature T1 to the second temperature T2. In this manner, if the valve controller 42 can regulate the distribution rates of the working medium on the basis of temperatures of the gas phase working medium which has flown out from the respective first and second heat exchangers 21, 22, various calculation methods may be employed. Alternatively, the first degree of superheat and the second degree of superheat may be used in place of the first temperature T1 and the second temperature T2.

In the above embodiments, regulation of the rotation frequency of the pump 30, that is, regulation of the total flow rate may be performed after the opening degree of the flow rate regulating valve V is regulated. Alternatively, regulation of the opening degree of the flow rate regulating valve V and regulation of the rotation frequency of the pump 30 may be performed at the same time.

In the above embodiments, the flow rate regulating valve V may be provided in the first branch flow passage 34*a* upstream of the first heat exchanger 21, and flow rate regulating valves may be provided in both of the first branch flow passage 34*a* and the second branch flow passage 34*b*. Alternatively, the flow rate regulating valve V may be a three way valve provided at the branch part, that is, the connection part of the upstream end portions of the respective branch flow passages 34*a*, 34*b*.

In the above embodiments, an example in which the total flow rate controller 44 regulates by controlling the rotation frequency of the pump 30 the total flow rate of the liquid phase working medium flowing into the respective first and second heat exchangers 21, 22 has been described. However, the method of regulating the total flow rate is not be limited to this. For example, a bypass flow passage connected to the main flow passage 33 in such a manner as to bypass the pump 30, and a bypass valve provided in this bypass flow passage may be provided, and the total flow rate controller 44 may regulate by regulating an opening degree of the bypass valve the total flow rate of the liquid phase working medium flowing into the respective heat exchangers 21, 22.

In the embodiment as shown in FIG. 1, pressures of the working medium flowing out from the respective first and second heat exchangers 21, 22 are substantially the same, and these pressures may be thus obtained by only either the first pressure sensor 52 or the second pressure sensor 54. Alternatively, a pressure sensor may be provided downstream of the merging part of the first branch flow passage 34*a* and the second branch flow passage 34*b*. This also applies to the embodiment as shown in FIG. 7. Alternatively, also in the embodiment as shown in FIG. 4, it is possible that at least one of the pressure sensors 52, 54, 56 is provided.

In the above embodiments, as the dynamic force recovery unit for recovering dynamic force from the expander 24, a rotary machine in place of the generator 26 may be provided.

In the above embodiments, compressed gas has been described as an example of heat sources supplied to the respective heat exchangers 21, 22 to evaporate the liquid phase working medium. However, as the heat sources, fluid supplied from a plurality of external heat sources, such as hot water, vapor, or exhaust gas, may be used. For example, as a first heat source for the first heat exchanger 21, spring water may be used, and as a second heat source for the second heat exchanger 22, hot spring vapor may be used. Alternatively, as the plurality of heat sources, factory exhaust heat may be used. For example, factory exhaust water having a high temperature as a heat source may be supplied to the first heat exchanger 21, and exhaust gas having a high temperature as a heat source may be supplied to the second heat exchanger 22. Alternatively, as the heat sources, vapor generated through evaporation of cooling fluid which has been supplied to a heated wall surface, e.g. wall surface of an incinerator, to cool this wall surface may be used.

Three or more heat exchangers may be provided. The number of the heat exchangers and the number of the heat sources may not be necessarily the same, and heat energy from one heat source may be recovered by a plurality of heat exchangers.

What is claimed is:

1. An energy recovery device for recovering heat energy from different heat sources by a Rankine cycle, comprising:

a plurality of heat exchangers connected in parallel with each other in the Rankine cycle, the plurality of heat exchangers being arranged to receive heat from respective ones of the different heat sources, to thereby heat a liquid phase working medium in the Rankine cycle flowing in the plurality of heat exchangers;

an expander for expanding the working medium which has been subjected to heat exchange with the respective heat sources in the plurality of heat exchangers;

a dynamic force recovery unit for recovering dynamic force from the expander;

a condenser for condensing the working medium which has flown out from the expander;

a pump for sending the working medium which has flown out from the condenser to the plurality of heat exchangers;

a plurality of temperature sensors for detecting temperatures of the gas phase working medium which has flown out from each of the plurality of heat exchangers;

a plurality of pressure sensors for detecting pressures of the gas phase working medium which has flown out from each of the plurality of heat exchangers;

a flow rate regulating valve provided in at least one of a plurality of branch flow passages; and a regulator for controlling the flow rate regulating valve to regulate inflow rates of the liquid phase working medium flowing into each of the respective heat exchangers, the regulator performing control on the basis of respective degrees of superheat calculated on the basis of the temperatures detected by the plurality of the respective temperature sensors and the pressures detected by the plurality of the respective pressure sensors.

2. The energy recovery device according to claim 1, further comprising a total flow rate controller for regulating a total flow rate of the liquid phase working medium flowing into the plurality of heat exchangers, wherein the total flow rate controller regulates a flow rate of the liquid phase working medium sent by the pump, on the basis of respective degrees of superheat calculated on the basis of the temperatures detected by the plurality of the respective temperature sensors and the pressures detected by the plurality of the respective pressure sensors, such that an average of degrees of superheat of the gas phase working medium which has flown out from the plurality of heat exchangers falls within a particular range.

3. The energy recovery device according to claim 1, further comprising a total flow rate controller for regulating a total flow rate of the liquid phase working medium flowing into the plurality of heat exchangers, wherein the total flow rate controller regulates a flow rate of the liquid phase working medium sent by the pump, on the basis of respective degrees of superheat calculated on the basis of the temperatures detected by the plurality of the respective temperature sensors and the pressures detected by the plurality of the respective pressure sensors, such that a degree of superheat in which each gas phase working medium which has flown out from the plurality of heat exchangers has merged with each other, prior to flowing into the expander falls within a particular range.

4. A compression device comprising:

the energy recovery device according to claim 1;

a first compressor for compressing gas;

a second compressor for further compressing compressed gas discharged from the first compressor, wherein the plurality of heat exchangers of the energy recovery device include a first heat exchanger for recovering heat energy in compressed gas discharged from the first compressor and a second heat exchanger for recovering heat energy in compressed gas discharged from the second compressor.

5. The compression device according to claim 4, further comprising:

a pressure controller for making a pressure of gas discharged from the first compressor substantially constant and changing a pressure of gas discharged from the second compressor in response to a pressure demanded by a demander, wherein the regulator further regulates the inflow rates of the liquid phase working medium flowing into the plurality of heat exchangers on the basis of a change rate of a pressure or a temperature of gas discharged from the second compressor.

6. The compression device according to claim 4, wherein, in the case where temperatures of compressed gas discharged from the respective first and second compressors are maintained to be substantially constant, the regulator regulates the inflow rates of the liquid phase working medium flowing into the plurality of heat exchangers when regulating an operation of the energy recovery device prior to a supply of compressed gas to a demander.

7. An energy recovery method for recovering heat energy from different heat sources by using a Rankine cycle of a working medium, comprising:

(a) providing a plurality of heat exchangers connected in parallel with each other in the Rankine cycle, and arranged to receive heat from respective ones of the different heat sources;

(b) obtaining degrees of superheat of the gas phase working medium which has flown out from each of the plurality of heat exchangers; and (c) regulating inflow rates of the liquid phase working medium flowing into each of the plurality of heat exchangers on the basis of the degrees of superheat.

8. The energy recovery method according to claim 7, wherein the steps (a) through (c) are performed by using an energy recovery device including the plurality of heat exchangers, an expander for expanding the gas phase working medium which has been subjected to heat exchange with the heat sources in the plurality of heat exchangers, a dynamic force recovery unit for recovering dynamic force from the expander, a condenser for condensing the gas phase working medium which has flown out from the expander, a pump for sending the liquid phase working medium which has flown out from the condenser to the plurality of heat exchangers.

9. The energy recovery method according to claim 7, further comprising:

a step of regulating the total flow rate of the liquid phase working medium flowing into the plurality of heat exchangers such that an average of degrees of superheat of the gas phase working medium which has flown out from the plurality of heat exchangers falls within a particular range.

10. The energy recovery method according to claim 7, further comprising:

a step of regulating the total flow rate of the liquid phase working medium flowing into the plurality of heat exchangers such that a degree of superheat in which each gas phase working medium which has flown out from the plurality of heat exchangers has merged with each other, prior to flowing into the expander falls within a particular range.

11. An energy recovery device for recovering heat energy from different heat sources by a Rankine cycle, comprising:

a plurality of heat exchangers connected in parallel with each other in the Rankine cycle, the plurality of heat exchangers being arranged to receive heat from respective ones of the different heat sources, to thereby heat a working medium in the Rankine cycle flowing in the plurality of heat exchangers;

an expander for expanding the working medium which has been subjected to heat exchange with the respective heat sources in the plurality of heat exchangers;

a dynamic force recovery unit for recovering dynamic force from the expander;

a condenser for condensing the working medium which has flown out from the expander;

a pump for sending the working medium which has flown out from the condenser to the plurality of heat exchangers;

a plurality of temperature sensors for detecting temperatures of the gas phase working medium which has flown out from each of the plurality of heat exchangers;

a plurality of pressure sensors for detecting pressures of the gas phase working medium which has flown out from each of the plurality of heat exchangers;

a flow rate regulating valve provided in at least one of a plurality of branch flow passages; and means for controlling the flow rate regulating valve to regulate inflow rates of the liquid phase working medium flowing into each of the heat exchangers, on the basis of respective degrees of superheat calculated on the basis of the temperatures detected by the plurality of the respective temperature sensors and the pressures detected by the plurality of the respective pressure sensors.

* * * * *